United States Patent [19]

Brüderlin et al.

[11] Patent Number: 4,809,405

[45] Date of Patent: Mar. 7, 1989

[54] APPARATUS FOR COMPRESSING AND AUTOMATICALLY INTRODUCING A TEXTILE FIBRE STRAND INTO A FEED NIP

[75] Inventors: Hans R. Brüderlin; Hermann Gasser, both of Frauenfeld; Hans Rutz, Winterthur; Karl Curiger, Ffäffikon, all of Switzerland

[73] Assignee: Hollingsworth GmbH, Fed. Rep. of Germany

[21] Appl. No.: 96,709

[22] Filed: Sep. 14, 1987

[30] Foreign Application Priority Data

Sep. 22, 1986 [CH] Switzerland ..... 3783/86

[51] Int. Cl.[4] ..... B65H 54/80

[52] U.S. Cl. ..... 19/159 R; 19/288

[58] Field of Search ..... 19/159 R, 288

[56] References Cited

U.S. PATENT DOCUMENTS

| | | | |
|---|---|---|---|
| 4,372,010 | 2/1983 | Gauvain | 19/159 R |
| 4,485,528 | 12/1984 | Anahara et al. | 19/288 X |
| 4,539,729 | 9/1985 | Meile et al. | 19/288 |

FOREIGN PATENT DOCUMENTS

| | | |
|---|---|---|
| 3436526 | 4/1986 | Fed. Rep. of Germany . |
| 2270348 | 12/1975 | France . |
| 2005216 | 4/1979 | United Kingdom . |
| 2059474 | 4/1981 | United Kingdom . |
| 2132240 | 7/1984 | United Kingdom . |

*Primary Examiner*—Louis K. Rimrodt

*Attorney, Agent, or Firm*—Townsend and Townsend

[57] ABSTRACT

In an apparatus for compressing and automatic introduction of a fibre strand into a feed nip: an opening is formed as a longitudinal slot (12, 12*a, b*12″*a*) extending from the outlet port (15) of the nozzle channel (7;7″) in the longitudinal direction thereof and in a plane extending substantially perpendicular to the plane (E—E) of the feed nip (1; 1″). The contour of the insertion nozzle (6, 6″) adjacent its outlet end on both sides of the longitudinal slot (12, 12*a, b;* 12″*a*) is of a shape (9, 10;9″) conforming to the contours of the components (2, 3; 2″, 8″*a*), particularly rollers (2, 3) defining the feed nip (1; 1″).

13 Claims, 5 Drawing Sheets

Figures 1, 3:
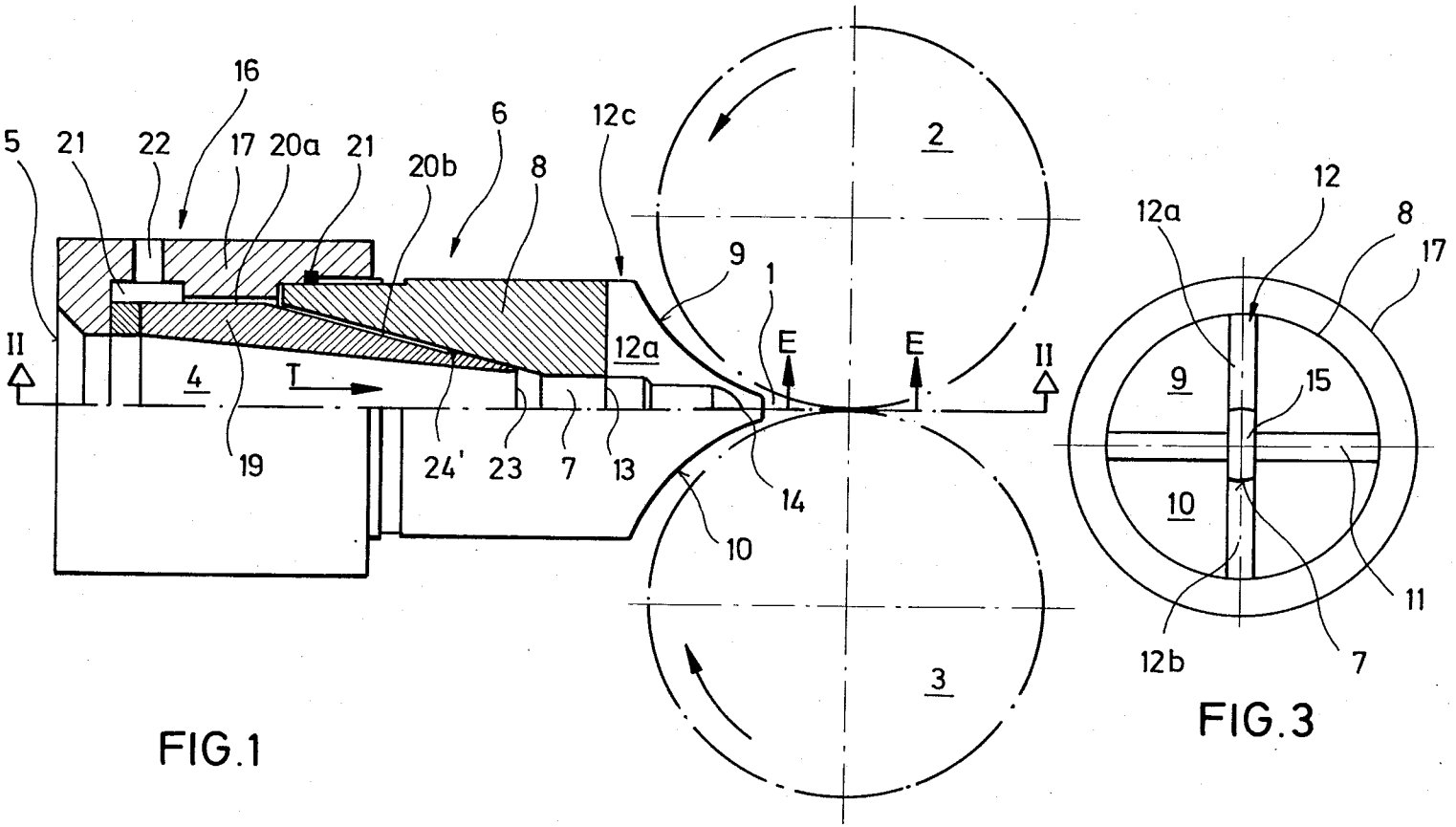

APPARATUS FOR COMPRESSING AND AUTOMATICALLY INTRODUCING A TEXTILE FIBRE STRAND INTO A FEED NIP

DESCRIPTION

The present invention relates to apparatus for compressing and automatically introducing a textile fibre strand into a feed nip, particularly a roller nip, comprising a feed passage, a flow generator for generating a gas flow in said feed passage, and an insertion nozzle extending from said feed passage and having a nozzle passage aligned with said feed passage and converging in the feed direction, as well as at least one lateral slot-shaped opening adjacent its outlet port for permitting said gas flow to escape from said nozzle passage.

Known from U.S. Pat. No. 4,318,206 (FIG. 3) is an apparatus of this type, wherein the nozzle has a series of slot cut therein and extending in planes perpendicular to the feed direction. These slots thus extend transversely of the longitudinal direction of the nozzle passage so as to form a kind of slotted grid extending over slightly more than half the circumference of the nozzle passage for permitting the feed gas flow to escape laterally therefrom. In this known embodiment the outlet port of the nozzle passage is formed as a planar circular opening and not shaped to conform to the contours of the rollers defining the feed nip. Fibres of the fibre strand tend to get caught by the edges of the slots extending transversely of the feed direction. Together with the transversely extending slots, the narrow circular outlet port acts as an insurmountable obstacle for unavoidable thickenings of the fibre strand. In the case of a fibre strand of unfavourable properties, this may result in jamming of the nozzle of the known apparatus, preventing the fibre strand from being reliably and automatically introduced into the feed nip and from being uniformly compressed.

Also known from U.S. Pat. No. 4,318,206 (FIGS. 1 and 2) is an apparatus wherein the nozzle passage does not converge in the feed direction, but is merely formed as an extension of the feed passage. Adjacent the outlet port this passage is provided with circumferentially arranged rows of bores permitting the feed gas flow to escape therethrough. In this embodiment the outlet end contour of the nozzle is shaped to conform to a certain degree to the contours of the rollers defining the feed nip. Since in this case the nozzle passage is of the same width as the feed passage, so that the fibre strand is not even partially compressed, the introduction of the large-diameter fibre strand into the roller nip cannot be reliably accomplished, particularly as the fibre strand is expanded by the escape of the feed gas flow in all directions, whereby its radially outer fibres tend to get caught on the edges of the bores.

It is an object of the invention to improve an apparatus of the type defined in the introduction in such a manner that it enables a textile fibre strand to be reliably and automatically introduced into a feed nip and to be simultaneously compressed.

According to the invention this object is attained by the provision that said opening is formed as a longitudinal slot extending from the outlet port of said nozzle passage in the longitudinal direction thereof in a plane substantially perpendicular to the plane of said feed nip, and in that the outlet end contour of said insertion nozzle on both sides of said longitudinal slot is shaped to conform to the contours of the components, particularly rollers, defining said feed nip.

The provision of the escape flow path for the feed gas flow in the form of a longitudinal slot extending in the feed direction offers the advantage that there are no obstacles extending transversely of the feed direction to interfere with the feed of the textile fibres. Inavoidable thickened portions of the fibre strand are capable of expanding radially into the longitudinal slot without the danger of the nozzle passage being jammed. The compression of the fibre strand is still reliably ensured, because adjacent the outlet port of the nozzle passage the fibre strand in guided in the plane of the feed nip between the sidewalls of the longitudinal slot and the nozzle passage, respectively, and in the plane perpendicular thereto, by the nozzle contour and the complementary contours of the components defining the feed nip, specifically of the compression rollers. The apparatus according to the invention thus grants a certain freedom to the fibre strand to expand radially to thereby avoid the danger of jamming; on the other hand, however, it ensures reliable compression of the fibre strand immediately before enttering the feed nip. Even in the case that individual fibres inadvertently project laterally from the longitudinal slot, they are immediately engaged by the peripheral surfaces of the compression rollers moving in the feed direction, to be thereby reintegrated into the fibre strand. The described effects are of particular importance with respect to the leading end of a fibre strand which may consist of individual strand portions. Although these strand portions tend to be retained adjacent the outlet port, they are capable of expanding laterally into the longitudinal slot to be engaged by the rollers as soon as a sufficient amount of fibre material has accumulated. This permits the leading end of a fibre strand to be reliably threaded into the feed nip. This application of the invention is of primary importance.

When the feed nip is defined by a pair of rollers, a longitudinal slot is preferably provided on both sides of the plane of the feed nip. This permits the fibre strand to expand transversely of the feed nip in both directions while still ensuring that it is compressed adjacent the outlet port opposite to the two directions of expansion.

When on the other hand the feed nip is defined by a roller and a stationary backup member, the longitudinal slot is preferably only formed in the side of the insertion nozzle facing towards the roller.

Preferably the nozzle passage is of circular cross-section and terminates a small distance upstream of the outlet port to communicate therewith solely through the longitudinal slot forming the outlet port, the width of the longitudinal slot being smaller than the diameter of the terminal section of the nozzle passage. In this embodiment the longitudinal slot defines the width of the fibre strand parallel to the plane of the feed nip, the longitudinal slot being effective to compress the fibre strand in this plane as it leaves the nozzle passage, while the compression in the plane prependicular thereto is subsequently accomplished by the components defining the feed slot.

Preferably the longitudinal slot has a radially opening upstream portion as seen in the feed direction. Since the contour of the nozzle adjacent the longitudinal slot is shaped to conform to the contours of the components definding the feed nip, the darailly opening upstream section of the longitudinal slot ensures the unrestricted escape of the feed gas flow.

The width of the longitudinal slot, in millimetres, may be of the magnitude of the weight of the fibre strand in grammes per meter, so that for a fibre strand of 5 g/m the width of the longitudinal slot is about 3–5 mm, preferably 4 mm.

In the case of the nozzle passage, an incremental decrease of its cross-sectional area in the direction towards the outlet port has been found advantageous. In contrast thereto the feed passage is preferably of conically convergent shape in the direction towards the nozzle passage.

In the apparatus known from U.S. Pat. No. 4,318,206, the flow generator is a suction fan aspirating air from an enclosed space surrounding the insertion nozzle, so that the air is replenished by being aspirated through the feed passage. Alternatively an air injector may be provided at a not specifically indicated location along the feed passage.

It has been found, however, that it is particularly advantageous with regard to the reliable introduction of the fibre strand into the feed nip to provide a flow generator in the form of a gas injector disposed immediately upstream of the nozzle passage. This provision has been found advantageous independent of the provision of the gas flow escape opening in the form of a longitudinal slot, so that independent protection is claimed therefor.

The gas injector preferably comprises a conically converging annular channel surrounding the feed passage and opening into the nozzle passage. This results in the generation of a concentrated gas flow effective to reliably advance the fibre strand through the outlet port of the insertion nozzle and into the feed nip.

Particularly reliable operation of the apparatus is achieved by the gas injector having a vortex generating means associated therewith. This results in the leading end of a fibre strand to be automatically constrained to form a pointed end.

The vortex generating means is preferably formed by helical grooves in the annular passage.

The apparatus according to the invention is particularly well suited for being mounted at the end of a feed pipe elbow of a rotary table opening into a coiling can. This permits a fibre strand to be deposited in the coiling can in an orderly and space-saving manner and without undue stresses or the danger of damage to the fibre strand.

Figure 2:
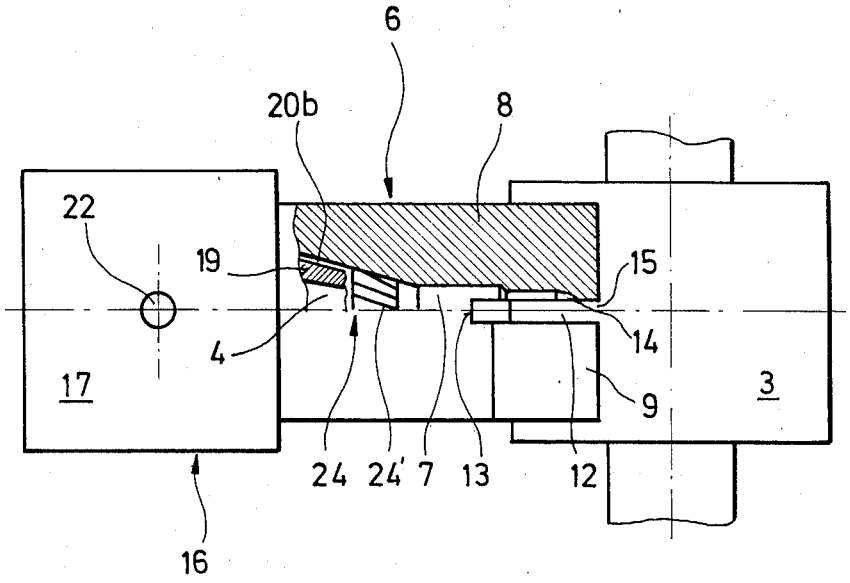
Figure 4:
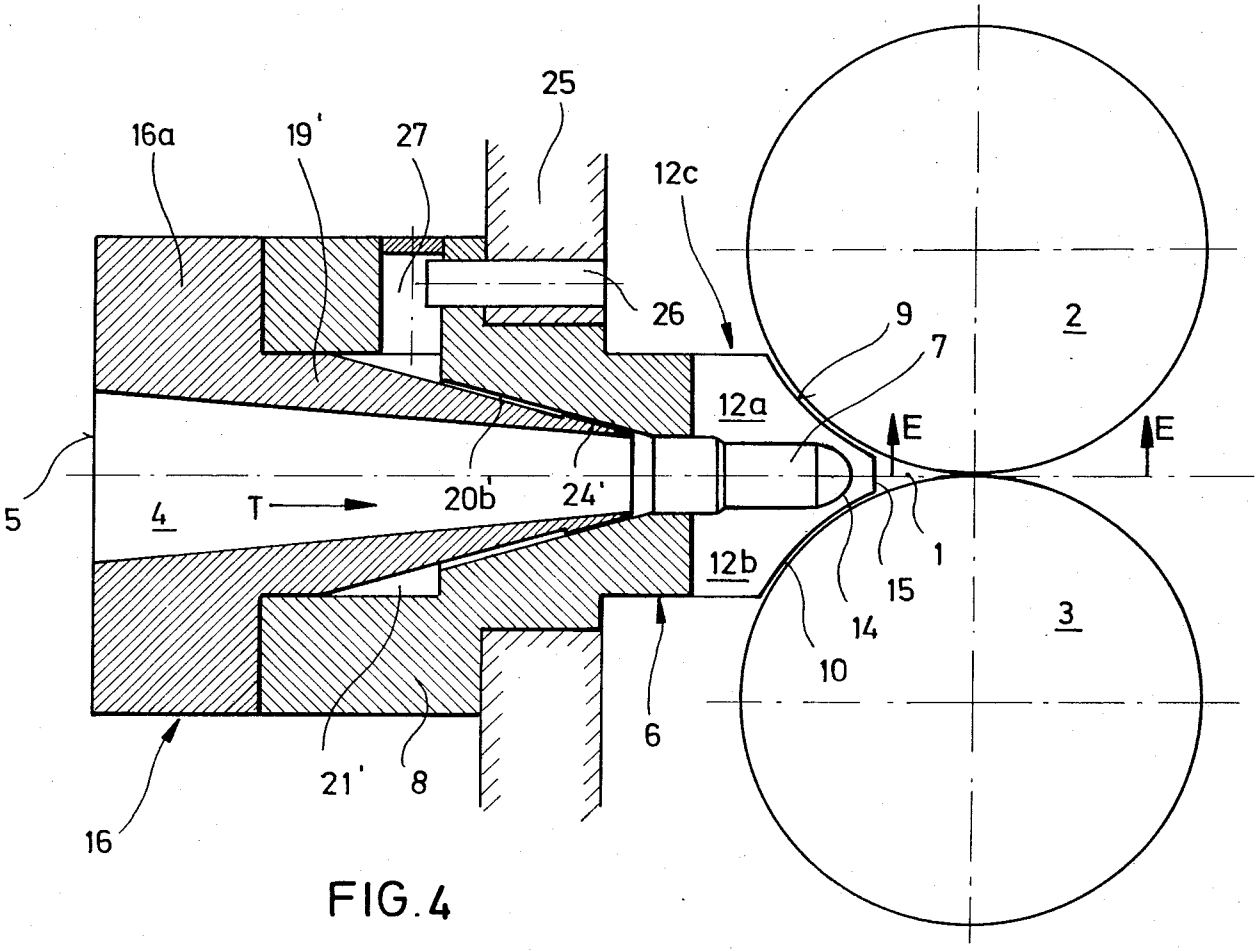

Embodiments of the invention shall now be described by way of example with reference to the drawings, wherein:

FIG. 1 shows a sideview, partially in longitudinal section, of the apparatus according to the invention in the plane of the feed nip transversely of the feed direction, FIG. 2 shows a view of the apparatus in the direction perpendicular to the plane of the feed nip and likewise transversely of the feed direction, partially sectioned along the line II—II in FIG. 1, and at a reduced scale with respect to FIG. 1, FIG. 3 shows an end view of the apparatus according to FIGS. 1 and 2, taken in the direction towards the outlet port, FIG. 4 shows a longitudinal sectional view taken perpendicular to the plane of the feed nip, of an embodiment of the apparatus according to the invention as modified with respect to the embodiment of FIGS. 1 to 3, FIG. 5 shows a vertical sectional view of a further embodiment of the apparatus according to the invention, taken perpendicular to the plane of the feed nip.

Figure 6:
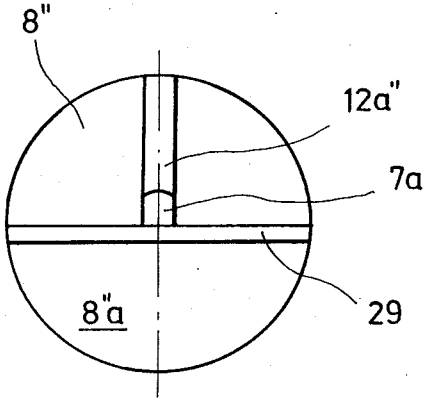
Figure 5:
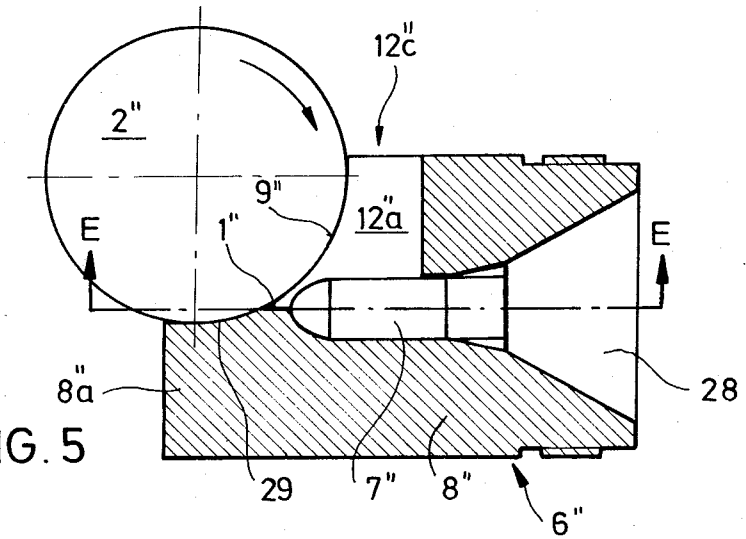
Figure 7:
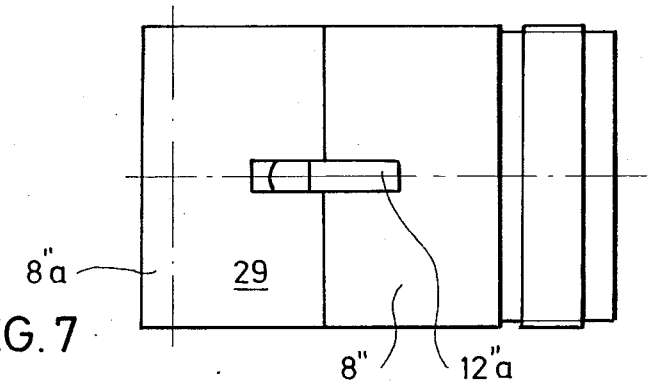
Figure 8:
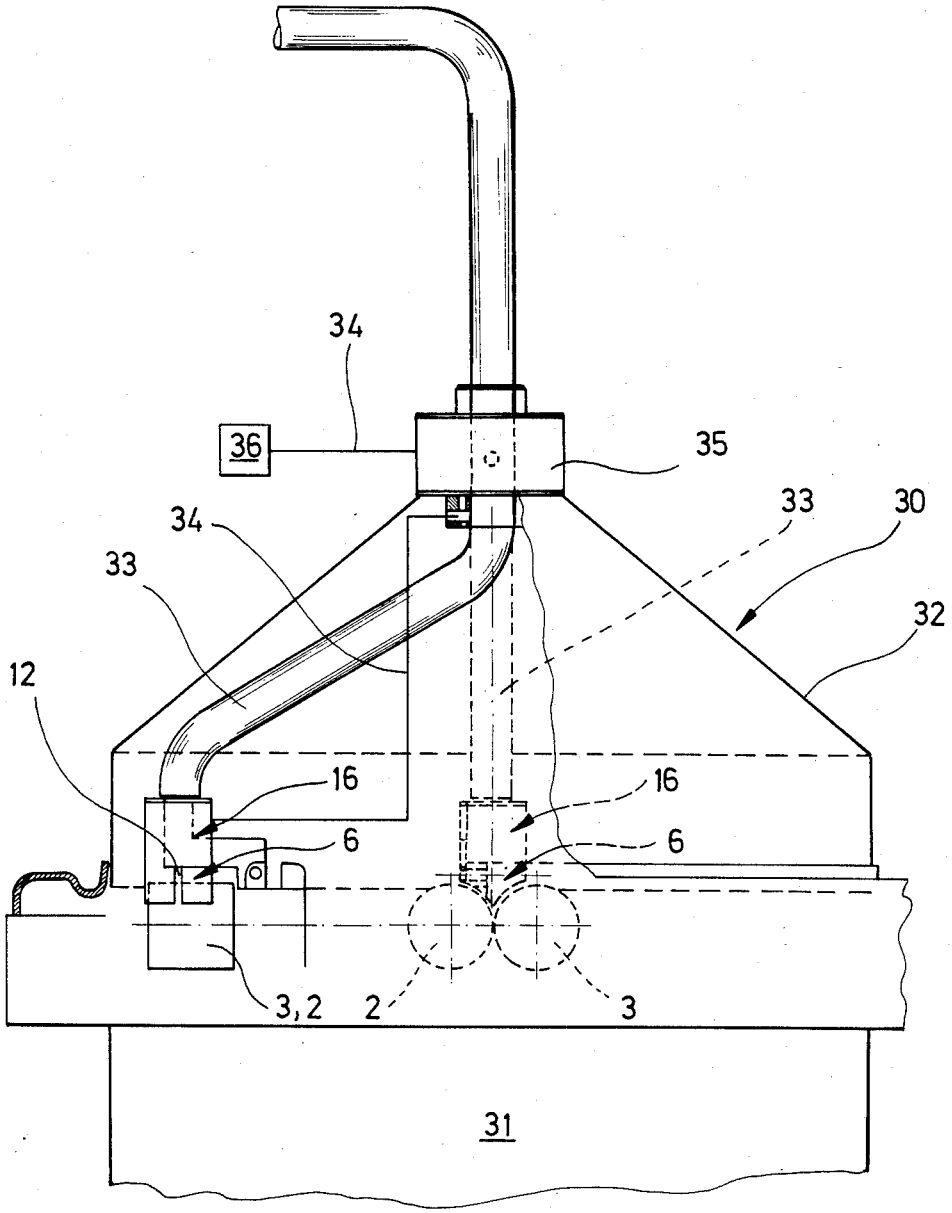

FIG. 6 shows an end view of the apparatus according to FIG. 5, taken in the direction towards the outlet port, FIG. 7 shows a top plan view of the apparatus according to FIGS. 5 and 6, taken perpendicular to the plane of the feed nip, and FIG. 8 shows a sideview, partially shown in vertical section, of a rotary table equipped with the apparatus according to the invention.

Shown in FIGS. 1–3 is an apparatus for introducing a fibre strand into a feed nip 1 and at the same time for compressing the fibre strand. In the embodiment shown, feed nip 1 is defined by a pair of compression rollers 2, 3. The plane of feed nip 1 is indicated at E—E. Compression rollers 2, 3 are rotated in opposite directions as indicated by respective arrows.

The apparatus comprises a feed passage 4 of conically converging shape in the feed direction T, the inlet end 5 of feed passage 4 communicating with a conventional feed passage in which a textile fibre strand is advanced for instance with the aid of a feed air flow. The apparatus further comprises an insertion nozzle 6 having a nozzle passage 7 extending therethrough in coaxial alignment with feed passage 4. The cross-sectional area of nozzle passage 7is incrementally reduced in the feed direction T, the resulting shoulders being chamfered or rounded for reducing the flow resistance. In contrast thereto feed passage 4 is of conically convergent shape in the feed direction T Insertion nozzle 6 essentially consists of a cylindrical body 8, the end face of which facing towards rollers 2, 3 is formed with recessed portions 9, 10 above and below the plane E—E of feed nip 1, so that the end face contour of insertion nozzle 6 conforms to the circular arc contours of rollers 2, 3 on both sides of the feed nip 1 as clearly shown in FIG. 1. Between recessed portions 9 and 10 there remains an end wall surface 11 extending perpendicular to feed direction T (FIG. 3).

Cut into the downstream end of body 8 is a longitudinal slot 12 extending in the longitudinal direction of nozzle passage 7 in a plane perpendicular to plane E—E of feed nip 1. In the embodiment of FIGS. 1–3, in which feed nip 1 is defined by rollers on both sides, longitudinal slot 12 extends to both sides of feed nip plane E—E, its two respective portions being indicated at 12*a* and 12*b*, respectively. Interiorly and exteriorly of body 8 longitudinal slot 12 intersects nozzle passage 7 and recessed portions 9 and 10, respectively. In the direction opposite to feed direction T it extends over a length beyond recessed portions 9 and 10, so that its upstream section 12*c* opens radially outwards and is not obstructed by the contour of a roller or any other component defining the feed nip, as clearly shown in FIG. 1.

Up to its intersection 13 with longitudinal slot 12 nozzle passage 7 has a closed circular cross-section. At intersection 13, nozzle passage 7 opens into longitudinal slot 12, the width of which transversely of the feed direction T and in the plane E—E of feed nip 1 being smaller than the diameter of nozzle passage 7 at this point. As clearly shown in FIG. 1, nozzle passage 7 terminates at 14 at a small distance upstream of end wall surface 11 of body 8, so that the actual outlet port 15 of insertion nozzle 6 is defined by the walls of longitudinal slot 12.

The width of longitudinal slot 12 depends on the weight of the fibre strand. This width, in millimeters, should be of about the same magnitude as the weight of the fibre strand in grammes per meter. In the case of a fibre strand of 5 g/m, for which the apparatus according to FIGS. 1–3 is intended, the width of longitudinal slot 12 is 4 mm.

Attached to the end of insertion nozzle 6 facing away from outlet port 15 is a gas injector generally indicated at 16 and comprising a cylindrical housing 17. Housing 17 contains a sleeve 19 defining the conical section of feed passage 4. Sleeve 19 cooperates with housing 17 to define an annular passage section 20*a*, and with body 8 of insertion nozzle 6 to define an annular passage section 20*b* of conically convergent shape communicating with annular passage section 20*a* and sealed to the exterior by a gasket 21. Annular passage section 20*a* extends from an annular chamber 21 in housing 17 communicating through a connection bore 22 with a compressed air source (not shown). Annular passage section 20*b* opens inti nozzle passage 7 at 23. Associated to gas injector 16 is a vortex generating means 24 formed in the embodiment shown by helical grooves in annular passage section 20*b* (FIG. 2). The helical grooves may selectively be formed on sleeve 19 or in body 8.

The apparatus shown in FIGS. 1–3 operates as follows:

A fibre strand is conveyed through feed passage 4 in the direction T by conventional means, for instance with the aid of a feed air flow. At 23 a gas flow leaving annular passage section 20*b* at a high speed and with a helical flow pattern impinges on the fibre strand, causing the latter to be twisted and advanced through nozzle passage 7 and outlet port 15 into feed nip 1 between rollers 2 and 3. This operating manner is of particular importance for the leading end of a fibre strand. The twisting action causes the leading end to be formed into a point which is subsequently capable of being reliably and automatically introduced into the feed nip between the rollers.

The gas flowing in nozzle passage 7 is permitted to escape laterally through longitudinal slot sections 12*a*, 12*b*, the radially opening section 12*c* ensuring its unhindered escape. The fibre strand is radially compressed in the conical section of the feed passage, and subsequently by the incremental reduction of the cross-sectional area of the nozzle passage. From location 13 onwards, however, the fibre strand is able to expand into longitudinal slot sections 12*a* and 12*b* perpendicular to the plane E—E of feed nip 1, so that thickened portions of the strand will not cause it to jam or be broken. In the last portion of its path upstream of outlet port 15 the fibre strand is compressed in the plane of feed nip 1 by the walls of longitudinal slot 12 while still being able to expand perpendicularly thereto into the slot. Immediately after leaving outlet port 15 the fibre strand is then gripped by the compression rollers closely conforming to the contour of insertion nozzle 6 on both sides of feed nip 1, to be thereby compressed in the direction perpendicular to the plane of the feed nip. At this location jamming of the fibre strand is not longer to be feared, because it is gripped between the steadily advancing surfaces of the compression rollers. The fibre strand is thus compressed first in the radial direction from all sides, then only substantially in the plane of the feed nip, and finally in a direction perpendicular to this plane. Since at none of these locations there is any danger of the fibre strand being jammed or broken, the fibre strand is reliably and smoothly fed to roller pair 2, 3, while being compressed at the same time.

The components essential for the operation of the embodiment of FIG. 4 are substantially identical to respective components of the embodiment of FIGS. 1–3 and are therefor designated by the same reference numerals, a further detailed description of these components being omitted.

The apparatus according to FIG. 4 is mounted on a stationary support wall 25. Gas injector 16 comprises a flange 16*a* by means of which it is attached to the end face of body 8 of insertion nozzle 6. Instead of sleeve 19 shown in FIGS. 1–3, the gas injector is provided with an integrally formed bush 19*a* cooperating with nozzle body 8 to define an annular chamber 21' for the pressurized gas to be supplied thereto in this case via a passage 26 extending through support wall 25 and nozzle body 8, and a radial branch passage 27. Annular passage section 20*b* is in direct communication with annular chamber 21'.

The apparatus according to FIG. 4 operates in the same manner as the one according to FIGS. 1–3.

In the embodiment of FIGS. 5–7, a feed nip 1'' is defined by a compression roller 2'' rotating in the direction indicated by an arrow, and a stationary backup body 8''*a* formed integrally with body 8'' of insertion nozzle 6''. Body 8'' again contains nozzle passage 7''. A longitudinal slot 12''*a* is only provided on the side of the plane E—E of feed nip 1'' whereat compression roller 2'' is located. The end of body 8'' facing away from feed nip 1'' is formed with a conical recess 28 adapted to have a gas injector mounted therein in the same manner as in the embodiments of FIGS. 1–3 and 4, respectively.

In FIGS. 6 and 7 compression roller 2'' has been omitted. As evident from these figures, backup body 8''*a* is formed with a trough-shaped recess of a contour conforming to the circular arc contour of compression roller 2''.

The operation of this apparatus is again substantially similar to that of the previously described embodiments.

The described apparatus may cooperate with a further gas injector located at an upstream position for injecting a feed gas flow for the fibre strand. It is further possible to mount a monitoring element, for instance a capacitive sensor, in the feed path of the fibre strand, preferably at a location downstream of the transition from the enclosed nozzle passage to the terminal portion of this passage opening into the longitudinal slot. Furthermore the boundary faces of the escape path formed by the longitudinal slot may smoothly merge with the circumferential surface of the nozzle without forming an edge therewith to thereby improve the escape of the gas flow.

For the insertion or threading of the leading end of a fibre strand into the apparatus gas injector 16 is activated for as short a time as possible to thereby produce a momentous pressure increase effective to propel the leading end of the textile fibre strand into the feed nip. The apparatus according to the invention is thus capable of inserting leading ends of any shape—blunt, torn or expanded—into a feed nip.

For achieving additional compaction of the strand material upstream of the feed nip, the outlet-end portions of the walls of the insertion nozzle may be adjustable, so that their spacing may be reduced after the leading end of the strand material has been introduced into the feed nip.

Shown in FIG. 8 by way of example is a practical application of the invention to be described in detail hereunder. It evolves the use of a rotary table 30 of a partially shown coiling can 31. Rotary table 30 comprises a feed pipe elbow 33 rotatably mounted in a top cover 32 and carrying at it slower end facing towards coiling can 31 an apparatus according to the invention as described with reference to FIGS. 1–3. As clearly shown in the figure, gas injector 16 is connected to the lower end of feed pipe elbow 33. Disposed below gas injector 16 is the nozzle 6 with its longitudinal slot 12. Mounted again below nozzle 6 are the two compression rollers 2, 3 defining the feed nip.

The gas injector 16 is supplied with compressed air from a compressed air source 36 via a compressed air conduit 34 extended through the rotary joint 35. While the section of conduit 34 extending between compressed air source 36 and rotary joint 35 is stationary with respect to cover 32, the section of conduit 34 extending between rotary joint 35 and gas injector 16 is rotated in unison with the feed pipe elbow.

In the lefthand half of FIG. 8 feed pipe elbow 33 is shown in solid lines. At the center of FIG. 8, whereat the feed pipe elbow is depicted in broken lines, it has been rotated by 90° about rotary joint 35 from the position shown in the lefthand half of the figure. During this rotation the fibre strand is simultaneously fed through feed pipe elbow 33, gas injector 16 and the nip of compression rollers 2 and 3 for being deposited in coiling can 31.

We claim:

1. Apparatus for compressing and automatically introducing a textile fibre strand into a feed nip (1; 1''), particularly a roller nip, comprising a feed passage (4), a flow generator (16) for generating a gas flow in said feed passage, and an insertion nozzle (6; 6'') extending from said feed passage and having a nozzle passage (7; 7'') aligned with said feed passage and converging in the feed direction, as well as at least one lateral slot-shaped opening adjacent its outlet port for permitting said gas flow to escape from said nozzle passage, characterized in that said opening is formed as a longitudinal slot (12, 12*a*, 12*b*; 12''*a*) extending from the outlet port (15) of said nozzle passage (7; 7'') in the longitudinal direction thereof in a plane subsantially perpendicular to the plane (E—E) of said feed nip (1; 1''), and that the outlet end contour (9; 9''; 10) of said insertion nozzle (6; 6'') on both sides of said longitudinal slot (12, 12*a*, 12*b*; 12''*a*) is shaped to conform to the contour of the components (2, 3; 2''; 8''*a*), particularly rollers (2, 3) defining said feed nip (1; 1'').

2. Apparatus according to claim 1, characterized in that when said feed nip (1) is defined by a pair of rollers (2, 3), a longitudinal slot (12*a*, 12*b*) is provided on both sides of said plane (E—E) of said feed nip (1).

3. Apparatus according to claim 1, characterized in that when said feed nip (1'') is defined by a roller (2'') and a stationary back-up body (8''*a*), said longitudinal slot (12''*a*) is formed in the side of said insertion nozzle (6'') facing towards said roller (2'').

4. Apparatus according to claim 1, characterized in that said nozzle passage (7) is of circular cross-section and terminates a short distance upstream of said outlet port (15) so as to communicate therewith solely through said longitudinal slot (12) forming said outlet port, the width of said longitudinal slot being smaller than the diameter of the terminal portion of said nozzle passage (7).

5. Apparatus according to claim 1, characterized in that, as seen in the feed direction (T), said longitudinal slot (12; 12''*a*) has a radially opening upstream section (12*c*; 12''*c*).

6. Apparatus according to claim 1, characterized in that the width of said longitudinal slot (12; 12''*a*) is about 3–5 mm, particularly 4 mm, for a fibre strand of 5 g/m.

7. Apparatus according to claim 1, characterized in that the cross-sectional area of said nozzle passage (7; 7'') is incrementally decreased in the direction towards said outlet port (15).

8. Apparatus according to claim 1, characterized in that said feed passage (4) is of conically convergent shape in the direction towards said nozzle passage (7).

9. Apparatus according to claim 1, characterized in that said flow generator is a gas injector (16) disposed immediately upstream of said nozzle passage (7).

10. Apparatus according to claim 9, characterized in that said gas injector (16) comprises a conically converging annular passage (20*a*, 20*b*) surrounding said feed passage (4) and opening into said nozzle passage (7).

11. Apparatus according to claim 9, characterized in that said gas injector (16) has a vortex generating means (24) associated therewith.

12. Apparatus according to claim 11, characterized in that said vortex generating means (24) consists of helical grooves (24') in said annular passage (20, 20*b*).

13. Apparatus according to claim 1, further including a rotary table (30) which opens into a coiling can (31), said table (30) including a feed pipe elbow (33) whereon said apparatus is mounted.

* * * * *